US006260483B1

(12) United States Patent
Snyder

(10) Patent No.: US 6,260,483 B1
(45) Date of Patent: Jul. 17, 2001

(54) REMOTE RADIO CONTROLLED PLASMA FIRING SYSTEM

(76) Inventor: Richard N. Snyder, P.O. Box 220, Garrisonville, VA (US) 22463

( * ) Notice: Subject to any disclaimer, the term of this patent is extended or adjusted under 35 U.S.C. 154(b) by 0 days.

(21) Appl. No.: 09/296,287

(22) Filed: Apr. 22, 1999

Related U.S. Application Data

(60) Provisional application No. 60/082,869, filed on Apr. 24, 1998.

(51) Int. Cl.[7] ..... F42B 3/11

(52) U.S. Cl. ..... 102/218; 102/218; 102/214; 102/200; 102/248; 102/202.8

(58) Field of Search ..... 102/218, 214, 102/200, 202.8, 275.11; 361/248

(56) References Cited

U.S. PATENT DOCUMENTS

| | | | | |
|---|---|---|---|---|
| 3,646,471 | * | 2/1972 | DeMent | 331/94.5 |
| 3,721,886 | * | 3/1973 | Phinney et al. | 320/1 |
| 3,834,310 | * | 9/1974 | Ueda et al. | 102/22 |
| 4,026,215 | * | 5/1977 | Ziemba et al. | 102/70.2 |
| 4,106,073 | * | 8/1978 | Coultas et al. | 102/28 R |
| 4,261,263 | * | 4/1981 | Coultas et al. | 102/28 R |
| 4,576,093 | | 3/1986 | Snyder | 102/200 |
| 4,615,268 | * | 10/1986 | Nakano et al. | 102/217 |
| 4,860,653 | * | 8/1989 | Abouav | 102/200 |
| 4,884,506 | * | 12/1989 | Guerreri | 102/200 |
| 5,088,411 | * | 2/1992 | Kurokawa | 102/200 |
| 5,144,893 | * | 9/1992 | Zeman et al. | 102/275.11 |
| 5,425,570 | * | 6/1995 | Wilkinson | 299/14 |
| 5,597,973 | * | 1/1997 | Gladden et al. | 102/275.11 |
| 5,714,712 | * | 2/1998 | Ewick et al. | 102/275.11 |
| 6,064,789 | * | 7/2000 | Hansson et al. | 361/111 |

* cited by examiner

*Primary Examiner*—Charles T. Jordan
*Assistant Examiner*—Lulit Semunegus
(74) *Attorney, Agent, or Firm*—Venable; Richard L. Aitken

(57) ABSTRACT

In a radio remote blasting system, a radio receiver triggers a blocking oscillator which generates a high voltage output. A rectifier rectifies the high voltage output and charges a capacitor, which is coupled to a plasma arc generator to apply the capacitor voltage to the plasma arc generator and generate a high voltage arc in the arc generator. The end of a shock tube is received in a port in the arc generator and the arc produced in the arc generator will ignite explosive material in the shock tube. The resulting explosion will travel from the point of ignition to an explosive device which will then be detonated.

3 Claims, 2 Drawing Sheets

REMOTE RADIO CONTROLLED PLASMA FIRING SYSTEM

CROSS REFERENCE TO RELATED APPLICATION

This application claims the benefit of Provisional Application Ser. No. 60/082,869, filed Apr. 24, 1998.

This invention relates to a radio remote blasting system and, more particularly, to a blasting system employing a shock tube, detonating cord, or other explosive line firing device to ignite the explosive device.

BACKGROUND OF THE INVENTION

This invention is an improvement in the system described in U.S. Pat. No. 4,576,093, issued Mar. 18, 1986, to the inventor of this invention, Richard N. Snyder. This patent is hereby incorporated by reference.

The above-mentioned patent describes a remote radio blasting system employing a radio transmitter controlled by a tone generating handset and a receiver receiving DTMF codes from the transmitter. The receiver decodes received DTMF codes to first arm and then fire a firing circuit, which electrically detonates blasting caps to cause the detonation of the explosives.

SUMMARY OF THE INVENTION

The system of the present invention employs a transmitter and receiver like that described in the above-identified patent. In the present invention, the receiver triggers a blocking oscillator which generates a high output voltage by means of a transformer. The high voltage output of the blocking oscillator is rectified and is used to charge a capacitor to a high voltage. The capacitor voltage is coupled by means of a coupling circuit to a plasma arc coupler which is designed to generate a high voltage arc. The capacitor will discharge through the arc in the plasma coupler showering explosive material in the end of a shock tube with electrons and molten metal atomic particles from the plasma coupler. The high voltage arc will ignite the explosive material in the end of the shock tube and the explosion will travel along the shock tube to the explosive device, which will then detonate. In this manner, the shock tube is ignited without the use of blasting caps or pyrotechnic initiators, thus eliminating a need for a volatile explosive ignition at the receiver.

DESCRIPTION OF THE PREFERRED EMBODIMENT

Figure 1:
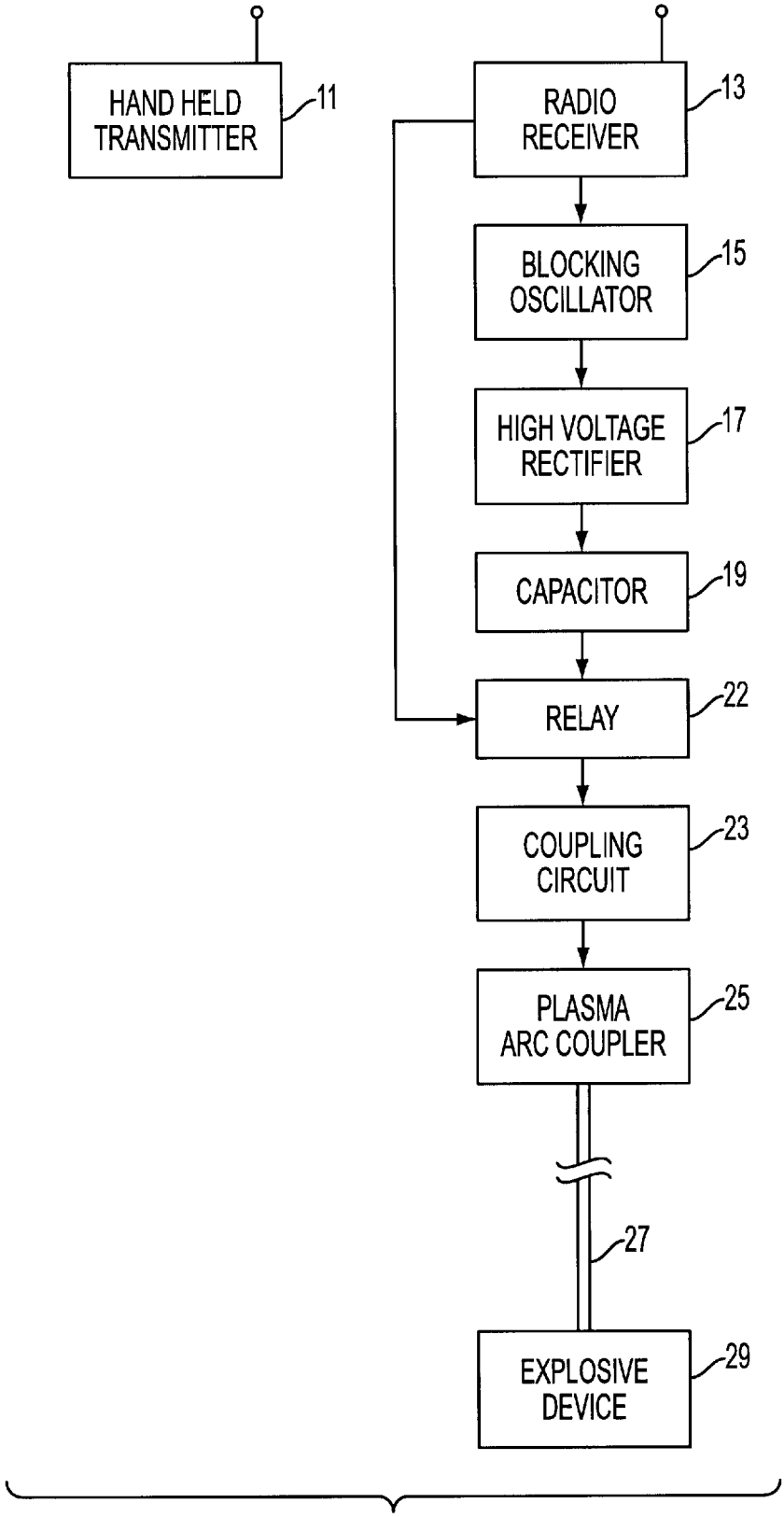
FIG. 1 is a block diagram illustrating the system of the new invention.

As shown in FIG. 1, a radio transmitter 11 can transmit coded arming signals and firing signals to a radio receiver 13. In the preferred embodiment, the transmitter 11 and the receiver 13 are transceivers. In response to the received arming signals, the receiver becomes armed, and actuates a blocking oscillator 15, which will generate a high voltage output through an output transformer. The high voltage output is rectified by a high voltage rectifier 17 and charges a capacitor 19 to a high voltage so that an electric charge reservoir is stored on the capacitor. After the receiver 13 is armed, a firing signal may be transmitted to the receiver 13, which in response to the firing signal will actuate a relay 22 to apply the high voltage generated across the capacitor to a plasma arc coupler 25 via a coupling circuit 23. The high voltage applied from the capacitor will generate a 1700 volt or higher arc in the plasma arc coupler and the capacitor 19 will discharge through the arc. The arc will ignite the explosive material in a shock tube 27, which will carry a traveling explosion along the length of the shock tube to an explosive device 29. Typically, the explosive material in the shock tube will be the material PETN. The explosion will travel along the shock tube 27 at 6,000 feet per second. The traveling explosion upon reaching the explosive device 29 will detonate the explosive device either directly or through a blasting cap.

Figure 2:
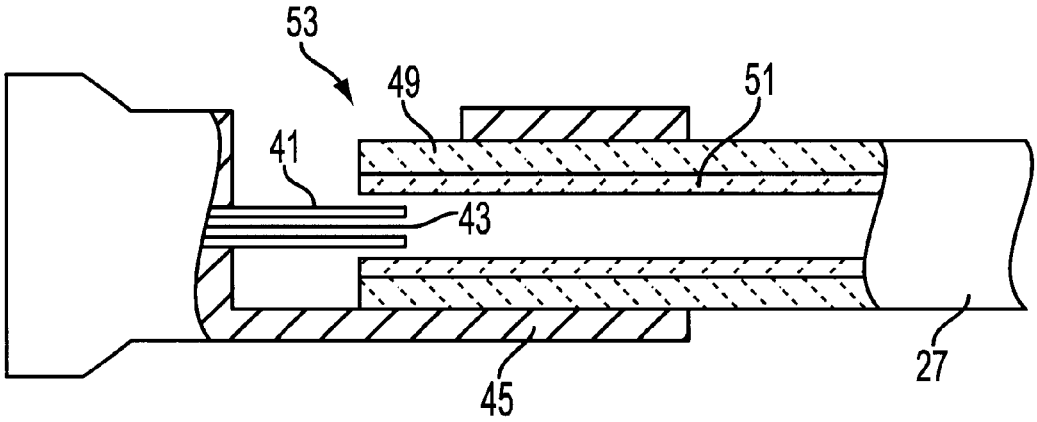
FIG. 2 is a partial sectional view of the plasma arc coupler of the invention used to ignite the shock tube, which is shown inserted into a shock tube port of the coupler.

As shown in FIG. 2, the plasma arc coupler comprises an outer conducting shell 41 and an inner conductor 43 mounted in a tubular housing 45. The shock tube 27 is inserted into a port defined by the tubular housing 45 so that the plastic wall 49 of the shock tube and the explosive material 51 lining the wall of the shock tube surround the outer conducting shell 41. A cut groove or window 53 is provided in the tubular housing so that the positioning of the end of the shock tube in the coupler can be observed and also to permit the spark generated by the coupler to be observed during testing. When the high voltage from the capacitor is applied to the plasma coupler, it generates a high voltage arc that discharges between the outer and inner conducting shells 41 and 43. The high voltage arc will consist of electrons that blast a shower of millions of molten metal atomic particles into a cloud in the port of the coupler, in which the end of the shock tube 27 is received, and will cause the explosive material 51 in the end of the shock tube 27 to ignite. The explosion will travel from the point of ignition of the shock tube along the shock tube to the explosive device and achieve the desired detonation of the explosive device 29.

Instead of employing a shock tube, the system could employ other forms of explosives transmitting lines, such as a detonation cord or a dual ignition line like that disclosed in the Richard N. Snyder U.S. Pat. No. 5,431,100, issued Jul. 11, 1995. Instead of using a blocking oscillator to generate the high voltage for the arc, other forms of triggerable high voltage sources may be employed.

The above description is of a preferred embodiment of the invention and modification may be made thereto without departing from the spirit and scope of the invention which is defined in the appended claims.

What is claimed is:

1. A radio remote explosive detonating system comprising an explosion transmitting line containing an explosive material, a plasma arc coupler comprising a pair of conductors, said coupler receiving an end of said explosion transmitting line positioned in said coupler, said explosion transmitting line, upon said explosive material being ignited, generating a traveling explosion traveling along the length of said explosion transmitting line, a radio transmitter operable to transmit a firing signal, a receiver operable to receive said firing signal, a coupling circuit connected between said receiver and said plasma coupler to apply a high voltage between said conductors in said plasma coupler and generate an arc in response to being triggered, said plasma coupler applying said arc with a cloud of molten metal particles to said explosive material to ignite said explosive material, said receiver triggering said high voltage coupling circuit in response to receiving said firing signal from said transmitter.

2. A system as recited in claim 1, wherein said coupling circuit comprises a blocking oscillator operable to generate a high voltage output upon being triggered, a high voltage rectifier connected to said blocking oscillator to rectify the high voltage output of said blocking oscillator, a capacitor connected to be charged by the rectified high voltage output of said high voltage rectifier, said capacitor being connected to said plasma arc coupler to discharge through said arc.

3. A system as recited in claim 1, wherein said explosion transmitting line is connected between said plasma coupler and an explosive device, said explosion transmitting line, upon the explosive material in the end of said explosion transmitting line being ignited by arc in said plasma coupler, carrying a traveling explosion along said explosion transmitting line to said explosive device and detonating said explosive device.

* * * * *